US008952300B2

(12) United States Patent
Malone et al.

(10) Patent No.: US 8,952,300 B2
(45) Date of Patent: Feb. 10, 2015

(54) HEATING CABLE

(75) Inventors: Neil Malone, Knutsford (GB); Jason Daniel Harold O'Connor, Glossop (GB)

(73) Assignee: Heat Trace Limited, Frodsham (GB)

( * ) Notice: Subject to any disclaimer, the term of this patent is extended or adjusted under 35 U.S.C. 154(b) by 136 days.

(21) Appl. No.: 13/051,313

(22) Filed: Mar. 18, 2011

(65) Prior Publication Data

US 2011/0226754 A1 Sep. 22, 2011

Related U.S. Application Data

(63) Continuation of application No. PCT/GB2009/002234, filed on Sep. 17, 2009.

(30) Foreign Application Priority Data

Sep. 18, 2008 (GB) ..... 0817082.1

(51) Int. Cl.
*H05B 3/02* (2006.01)
*H05B 3/56* (2006.01)

(52) U.S. Cl.
CPC ..... *H05B 3/56* (2013.01); *H05B 2203/019* (2013.01); *H05B 2203/02* (2013.01)
USPC ..... 219/538; 219/542; 219/543; 219/544

(58) Field of Classification Search
USPC ..... 219/546, 553, 538, 542, 543, 544
See application file for complete search history.

(56) References Cited

U.S. PATENT DOCUMENTS 4,271,350 A * 6/1981 Crowley ..... 219/549
4,330,703 A * 5/1982 Horsma et al. ..... 219/553
4,392,051 A * 7/1983 Goss et al. ..... 219/528

(Continued)

FOREIGN PATENT DOCUMENTS

CA 2 652 012 A1 11/2007
CN 1113067 A 12/1995

(Continued)

OTHER PUBLICATIONS

"Trace Heating" downloaded from http://en.wikipedia.org/wiki/Trace)heating—Wikipedia, the free encyclopedia on Dec. 4, 2007. 3 pages.

(Continued)

*Primary Examiner* — Henry Yuen
*Assistant Examiner* — Ayub Maye
(74) *Attorney, Agent, or Firm* — Silicon Edge Law Group LLP; Arthur J. Behiel

(57) ABSTRACT

According to a first aspect of the present invention, there is provided a self-regulating electrical heating cable comprising: a first power supply conductor extending along the length of the cable; a second power supply conductor extending along the length of the cable; a third power supply conductor extending along the length of the cable; the first and second power supply conductors being in electrical connection with each other via a first electrically conductive heating element body having a positive temperature coefficient of resistance, and the second and third power supply conductors being in electrical connection with each other via a second electrically conductive heating element body having a positive temperature coefficient of resistance, and wherein, in use, the first, second and third power supply conductors are not physically connected to one another.

17 Claims, 5 Drawing Sheets

(56) References Cited

U.S. PATENT DOCUMENTS

| | | | | | |
|---|---|---|---|---|---|
| 4,508,934 | A * | 4/1985 | Feldman, Jr. | ..... | 174/101.5 |
| 4,717,761 | A * | 1/1988 | Staniland | ..... | 528/125 |
| 4,733,059 | A * | 3/1988 | Goss et al. | ..... | 219/548 |
| 5,060,287 | A * | 10/1991 | Van Egmond | ..... | 392/301 |
| 6,288,372 | B1 * | 9/2001 | Sandberg et al. | ..... | 219/544 |
| 2002/0121987 | A1 * | 9/2002 | Besser et al. | ..... | 340/854.9 |

FOREIGN PATENT DOCUMENTS

| | | | | | |
|---|---|---|---|---|---|
| EP | 0 008 235 | A2 | 2/1980 | | |
| EP | 0 096 492 | A1 | 12/1983 | | |
| GB | 2120909 | A | 7/1983 | | |
| GB | 2163330 | A | 2/1986 | | |
| WO | 2006/067485 | A1 | 6/2006 | | |
| WO | WO 2006067485 | A1 * | 6/2006 | ..... | H05B 3/56 |
| WO | 2007/132256 | A1 | 11/2007 | | |

OTHER PUBLICATIONS

The UK Search Report for application serial No. GB0817082.1. Search date: Feb. 13, 2009. 2 pages.

The UK Search Report for application serial No. GB0718289.2. Search date: Jan. 18, 2008. 1 page.

International Publication No. WO 2010/032017 A1. International Publication Date Mar. 25, 2010. Which includes the International Search Report for PCT/GB2009/002234. 28 pages.

* cited by examiner

HEATING CABLE

TECHNICAL FIELD

The present invention relates to heating cables. In particular, the invention relates to heating cables suitable for use with a three-phase power supply.

BACKGROUND

Heating cables are well known, and are used in a wide variety of applications. A typical heating cable conducts electricity, and in doing so dissipates in the form of heat some of the electrical energy which it conducts. The heating cable can be used to heat a pipe to ensure that the contents of the pipe are maintained at a certain temperature, for example above the freezing point of the contents. The heating cable maybe in contact with either the inside or the outside of the pipe, and may extend along the pipe in a linear fashion or be wound around the pipe. Heating cables also have other applications, for example under-floor heating, the heating of car seats and any other application where heating may be required.

In more recent decades, self-regulating heating cables have been designed. These self-regulating heating cables often comprise a material having a positive temperature coefficient of resistance. This means that as the heating cable gets hotter, its resistance increases. Since its resistance increases, the current flow to the cable is reduced, causing the temperature of the cable to reduce in a corresponding manner. Thus, the heating cable self-regulates. An advantage of self-regulating heating cables is their inherent safety properties. For example, self-regulating heating cables cannot overheat or burnout, since the cable can be constructed to reduced the current flow to almost zero at a pre-determined safe temperature (e.g. below the combustion temperatures of materials used to construct the cable or of materials in the environment in which the cable is used).

Most early heating cables were provided with one or more electrical conductors which ran along the length of the heating cable. These earlier heating cables were designed to be used with single-phase electrical power supplies. More recently, heating cables have been designed which take advantage of the benefits of three-phase electrical power supplies. For instance, single-phase heating cables can have circuit lengths of a few hundred meters, whereas three-phase heating cables can have circuit lengths of many kilometers.

Single-phase heating cables can either be constant power or self-regulating. However, existing three-phase heating cables are only constant power.

SUMMARY

It is an aim of the present invention to provide a self-regulating heating cable which may be used with a three phase power supply.

According to a first aspect of the present invention, there is provided a self-regulating electrical heating cable comprising: a first power supply conductor extending along the length of the cable; a second power supply conductor extending along the length of the cable; a third power supply conductor extending along the length of the cable; the first and second power supply conductors being in electrical connection with each other via a first electrically conductive heating element body having a positive temperature coefficient of resistance, and the second and third power supply conductors being in electrical connection with each other via a second electrically conductive heating element body having a positive temperature coefficient of resistance, and wherein, in use, the first, second and third power supply conductors are not physically connected to one another. First ends of each power supply conductor may be, in use, connected to a power supply, for example a three phase power supply. Second, remote ends of each power supply conductor are not physically connected together. In other words, these second ends of the power supply conductors (and, for that matter, all parts of the conductors other than the respective first ends) are in electrical connection with each other only via the electrically conductive heating element.

According to a second aspect of the present invention, there is provided a self-regulating electrical heating cable comprising: a first power supply conductor extending along the length of the cable; a second power supply conductor extending along the length of the cable; a third power supply conductor extending along the length of the cable; the first and second power supply conductors being in electrical connection with each other via a first electrically conductive heating element body having a positive temperature coefficient of resistance, and the second and third power supply conductors being in electrical connection with each other via a second electrically conductive heating element body having a positive temperature coefficient of resistance, and wherein, in use, the first, second and third power supply conductors are physically connected to one another. First ends of each power supply conductor may be, in use, connected to a power supply, for example a three phase power supply. Second, remote ends of each power supply conductor are physically connected together.

The first and/or second aspects of the present invention may have one or more of the features described below.

The first, second and third power supply conductors may extend alongside one another in a substantially planar arrangement. The second power supply conductor maybe located between the first and third power supply conductors. The first and third power supply conductors maybe equally spaced from the second power supply conductor.

The second power supply conductor may be provided with a coating of material. The coating of material may have a higher electrical resistance than the electrical resistance of the electrically conductive heating element body or bodies. Such a higher resistance may help to achieve a balanced resistance between the conductors, allowing a load to also be balanced between the conductors.

The first body may form part of a substantially hollow cylinder, and the second body may form part of substantially hollow cylinder. The self-regulating electrical heating may further comprise a third electrically conductive heating element body having a positive temperature coefficient of resistance, the third body forming part of substantially hollow cylinder and being arranged to electrically connect the third and first power supply conductors. The first, second and third power supply conductors maybe equally spaced apart around the substantially hollow cylinder. The first, second and third power supply conductors maybe equally spaced from a central longitudinal axis of the substantially hollow cylinder.

One or more of the power supply conductors maybe encased in material having a negative temperature coefficient of resistance. The material having a negative temperature coefficient of resistance maybe in the form of a sheath.

One or more heating element bodies may comprise two components, each component having a different positive temperature of resistance characteristic.

One or more heating element bodies may comprise a material having a negative temperature coefficient of resistance.

One or more heating element bodies may together form a single heating element body.

One of more of the power supply conductors maybe embedded in a heating element body.

According to a third aspect of the present invention, there is provided a self-regulating electrical heating cable comprising: a first power supply conductor extending along the length of the cable; a second power supply conductor extending along the length of the cable; a third power supply conductor extending along the length of the cable; one or more of the first, second and third power supply conductors being encased in material having a positive temperature coefficient of resistance, the first and second power supply conductors being in electrical connection with each other via a first electrically conductive heating element body having a negative temperature coefficient of resistance, and the second and third power supply conductors being in electrical connection with each other via a second electrically conductive heating element body having a negative temperature coefficient of resistance, and wherein, in use, the first, second and third power supply conductors are not physically connected to one another. First ends of each power supply conductor may be, in use, connected to a power supply, for example a three phase power supply. Second, remote ends of each power supply conductor are not physically connected together. In other words, these second ends of the power supply conductors (and, for that matter, all parts of the conductors other than the respective first ends) are in electrical connection with each other only via the electrically conductive heating element.

According to a fourth aspect of the present invention, there is provided a self-regulating electrical heating cable comprising: a first power supply conductor extending along the length of the cable; a second power supply conductor extending along the length of the cable; a third power supply conductor extending along the length of the cable; one or more of the first, second and third power supply conductors being encased in material having a positive temperature coefficient of resistance, the first and second power supply conductors being in electrical connection with each other via a first electrically conductive heating element body having a negative temperature coefficient of resistance, and the second and third power supply conductors being in electrical connection with each other via a second electrically conductive heating element body having a negative temperature coefficient of resistance, and wherein, in use, the first, second and third power supply conductors are physically connected to one another. First ends of each power supply conductor may be, in use, connected to a power supply, for example a three phase power supply. Second, remote ends of each power supply conductor are physically connected together.

Where appropriate, the third and/or fourth aspects of the present invention may have one or more of the features described above in relation to the first and/or second aspects of the present invention.

BRIEF DESCRIPTION OF THE FIGURES

Embodiments of the present invention will now be described, by way of example only and in which like features are given the same reference numerals, and in which.

DETAILED DESCRIPTION

Figure 1:
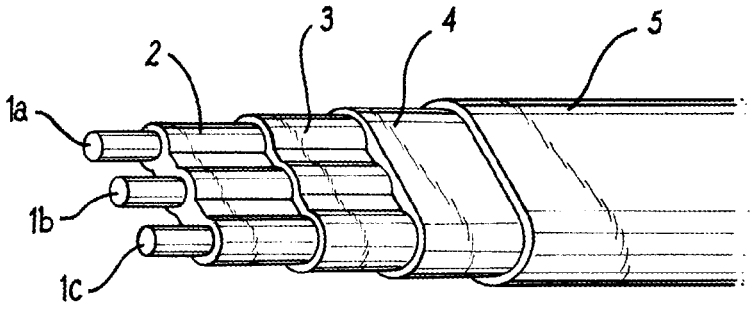
FIG. 1 depicts a heating cable in accordance with an embodiment of the present invention.

FIG. 1 depicts a heating cable in accordance with an embodiment of the present invention. The heating cable is provided with three electrical conductors 1*a*, 1*b*, 1*c* (e.g. copper wires, or the like) running along the length of the cable. Each of the conductors 1*a*, 1*b*, 1*c* are equally spaced apart from one another, and lie in substantially the same plane. The conductors 1*a*, 1*b*, 1*c* are embedded in an electrically conductive body 2 of material having a positive temperature coefficient of resistance (hereinafter referred to as 'the PTC body 2'). The conductors 1*a*, 1*b*, 1*c* may be embedded in the PTC body 2 in any appropriate manner. For example, the PTC body 2 may be extruded over and around the conductors 1*a*, 1*b*, 1*c*. Alternatively, the PTC body 2 may be formed (e.g. moulded) around the conductors 1*a*, 1*b*, 1*c*.

The conductors 1*a*, 1*b*, 1*c* of FIG. 1 can be formed from any suitable material that conducts electricity. For example, the conductors can be formed from copper, steel, etc. The electrically conductive PTC body 2 is formed from carbon particles embedded in a polymer such as polyethylene or the like. The PTC body 2 may be formed from any suitable material or compound which has a positive temperature coefficient of resistance. For example, the PTC body 2 may typically be formed from a mixture of a conductive material and an insulative material. The conductive material maybe a metal powder, carbon black, carbon fibres, carbon nanotubes or one or more PTC ceramics.

The PTC body 2 is surrounded by an insulating sheath 3. The insulating sheath 3 electrically isolates the PTC body 2 from a metallic braid 4. The metallic braid 4 gives the heating cable mechanical stability and strength. The metallic braid 4 is encased in an insulting jacket 5. The insulating jacket 5 electrically insulates the heating cable and reduces or eliminates the effects of wear and tear and the ingress of water, dirt etc.

In use, each of the conductors 1*a*, 1*b*, 1*c* will be attached to an output of a three-phase power supply (not shown). The heating cable can be cut to length, with the ends of the conductors 1*a*, 1*b*, 1*c* not connected to the three-phase power supply being exposed and connected together in a star point.

Figure 2A:
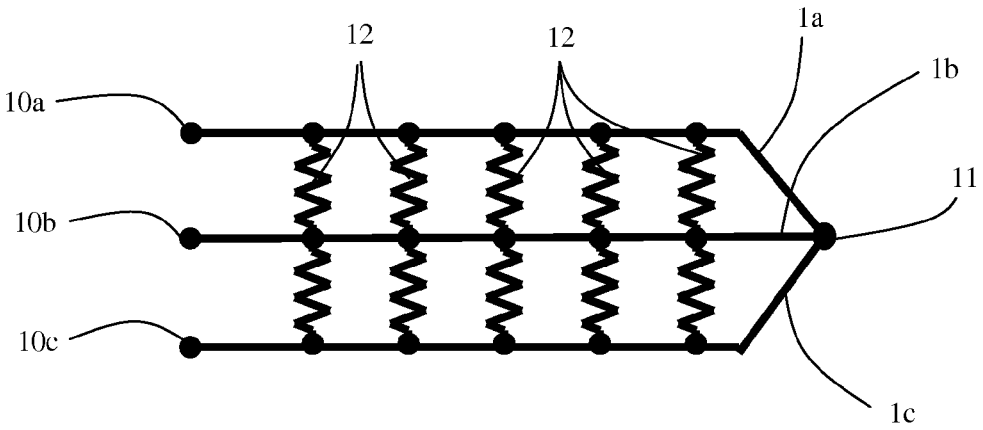
FIG. 2*a* depicts a schematic circuit diagram of electrical connections in the heating cable of FIG. 1.

FIG. 2*a* illustrates the electrical connections of the three-phase heating cable of FIG. 1. On the left hand side of FIG. 2*a* is shown connection points 10*a*, 10*b*, 10*c* where electrical connection is made between the heating cable and a three-phase power supply (not shown). On the right hand side of FIG. 2*a* is shown is star point 11 where the conductors 1*a*, 1*b*, 1*c* have been connected together. The star point is the path of least resistance between the conductors 1*a*, 1*b*, 1*c*. The PTC body 2 in which the conductors 1*a*, 1*b*, 1*c* are embedded is represented by a series of resistors 12. In practice, since the electrical conductors 1*a*, 1*b*, 1*c* are embedded in the PTC body 2, the number of resistors is effectively infinite (i.e. because the PTC body 2 is continuous). It can therefore be seen that all the conductors are in electrical connection with one another via the PTC body 2.

As mentioned previously, the PTC body 2 comprises carbon particles embedded in a polymer matrix. The carbon particles provide a large number of potential conductive pathways. Electricity will flow along these pathways more easily if the particles are in contact with each other or are close together (e.g. when the temperature of the PTC body 2 is low, such that the polymer of the body 2 does not expand and move the carbon particles too far apart). Conversely, electricity will flow along these pathways less easily if the particles are not close together (e.g. when the temperature of the PTC body 2 is high, such that the polymer of the body 2 expands and moves the carbon particles apart from one another).

Figure 2B:
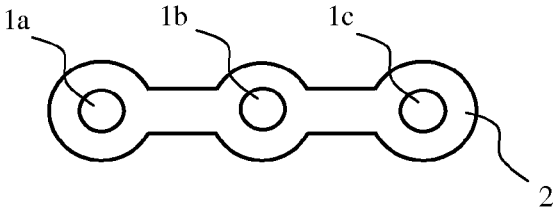
FIG. 2*b* depicts a schematic cross sectional view of a part of the heating cable of FIG. 1.

FIG. 2*b* depicts a cross sectional view of the electrical conductors 1*a*, 1*b*, 1*c* and PTC body 2 of FIG. 1. As discussed in the previous paragraph, the PTC body 2 is provided with a large number of carbon particles, and thus potential conductive pathways. FIG. 2*b* shows that the bulk of the PTC body 2 is located between conductor 1*a* and 1*b*, and also conductor 1*a* and 1*c*. This means that the majority of the carbon particles and thus potential conductive pathways will also be located between conductor 1*a* and 1*b*, and also conductor 1*a* and 1*c*, and not between conductors 1*a* and 1*c*. This means that, perhaps surprisingly, a load will be equally distributed across the heating cable (or at least more equally distributed than might be expected—ostensibly balanced), such that the cable can transmit a three-phase power supply. One or more additional or alternative reasons for the obtaining of a balance load are described in more detail below.

Figure 3:
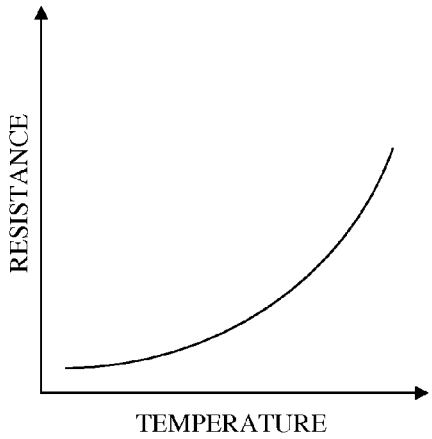
FIGS. 3 and 4 depict temperature-resistance characteristics of the heating cable of FIG. 1 and an alternative embodiment to that illustrates in FIG. 1.

FIG. 3 illustrates the temperature-resistance characteristic of the heating cable of FIG. 1. It can be seen that, as a consequence of the inclusion of the PTC body, the resistance of the cable increases as a function of temperature. It will be appreciated that this means that the heating cable of FIG. 1 is self-regulating. That is, if the temperature of the heating cable were to increase, its resistance will also increase. As the resistance of the heating cable increases, the current flowing through the heating cable will reduce, causing, in turn, the temperature of the cable to decrease. The heating cable self-regulates. Depending on the choice of PTC material used in the body, the heating cable can be designed to self-regulate around a specific temperature.

Figure 4:
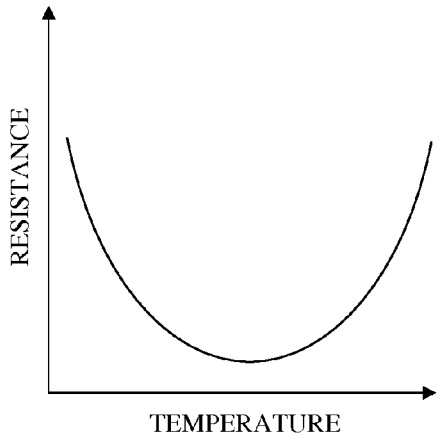

In another embodiment, one, two or three of the conductors 1*a*, 1*b*, 1*c* of FIG. 1 may be encased (e.g. by extrusion) in a sheath of material having a negative temperature coefficient of resistance. FIG. 4 shows the resistance-temperature characteristic of such a cable. It can be seen that when the temperature is low, the resistance of the cable is high. This means that if power is supplied to the heating cable when the temperature is low, the current flowing through the cable is not high. The use of the NTC material thus prevents what is known as a large 'in-rush' current into the cable during cold conditions. In yet another embodiment, one, two or three conductors may be encased (e.g. by extrusion) in a sheath of material having a positive temperature coefficient of resistance, and those encased cables then embedded in a body of material having a negative temperature coefficient. FIG. 4 also shows the resistance-temperature characteristic of such a cable. Again, it can be seen that when the temperature is low, the resistance of the cable is high. This means that if power is supplied to the heating cable when the temperature is low, the current flowing through the cable is not high. The use of the NTC material thus again prevents what is known as a large 'in-rush' current into the cable during cold conditions. In either of the embodiments discussed in this paragraph, the NTC material may comprise or be ceramic. The ceramic may be in powder form. The ceramic may comprise a mixture of 82% of Mn2O3 and 18% of NiO by weight. The NTC material may comprise or be located in a polymer matrix.

In embodiments where a mixture of NTC and PTC material are used, it is not essential that the NTC and PTC materials form or constitute a part of different elements of the cable (e.g. the casing of a conductor or the body in which the encased conductor is embedded). Instead, the NTC and PTC materials (or components) may be mixed together to form a single mass of material having both NTC and PTC properties and a temperature resistance characteristic similar to that shown in FIG. 4. The conductors may be embedded in this mass of material. A cable having a single mass of material having both NTC and PTC properties may also have some or all of the features of the cables described above or below.

Figure 5:
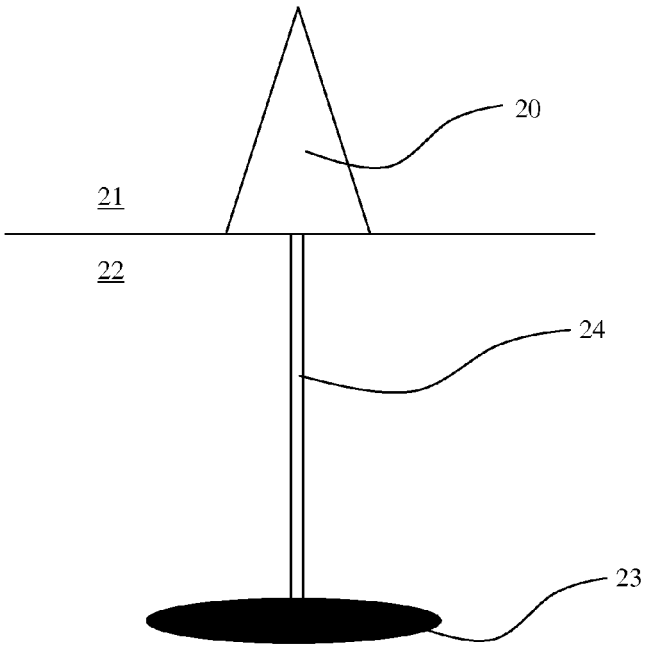
FIG. 5 depicts an application for the heating cable of embodiments of the present invention.

FIG. 5 depicts a suitable application for the heating cable of FIG. 1. FIG. 1 depicts an inland oil well 20. The oil well 20 is located above ground 21 (sometimes referred to as 'above grade'). Below the ground 22 (sometimes referred to as 'below grade') there is located an oil reservoir 23. Extending from the oil well 20, through the ground 22 and into the oil reservoir 23 is an oil production pipe 24. Oil may be transported from the reservoir 23 and up to the oil well 20 via the oil production pipe 24 in a known manner.

Figure 6:
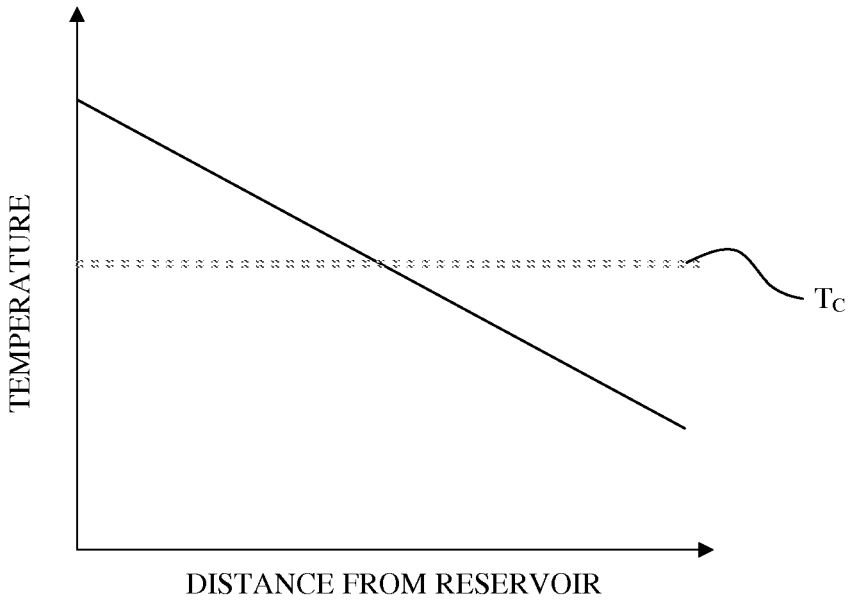
FIG. 6 depicts variations in temperature associated with the application of FIG. 5.

The oil reservoir 23 may contain oil having a temperature of 1000 C or more. When oil is extracted from the reservoir 23 via the oil production pipe 24, the oil's temperature decreases as it moves closer to the surface. This is due to a decrease in the temperature of the ground 22 surrounding the oil production pipe 24, and also the reduction in pressure on the oil as it travels up the oil production pipe 24 towards the oil well 20. FIG. 6 schematically depicts the temperature of the oil relative to its distance from the reservoir. It can be seen that, as described above, the temperature gradually decreases. At a specific temperature Tc, say for example 600C, a wax-like material is known to precipitate out of the oil. This wax-like material coats the inside of the oil production pipe and thereby restricts the size of the channel through which oil can be extracted from the reservoir. As a consequence of this wax-like material build up, extraction of oil from the reservoir often needs to be interrupted to clean the inside of the oil production pipe so that oil can be efficiently extracted from the reservoir. Typically, oil cannot be extracted from the reservoir when the oil production pipe is being cleaned of its wax-like material build up. Thus, the cleaning of the inside of the oil production pipe reduces the working efficiency.

Figure 7:
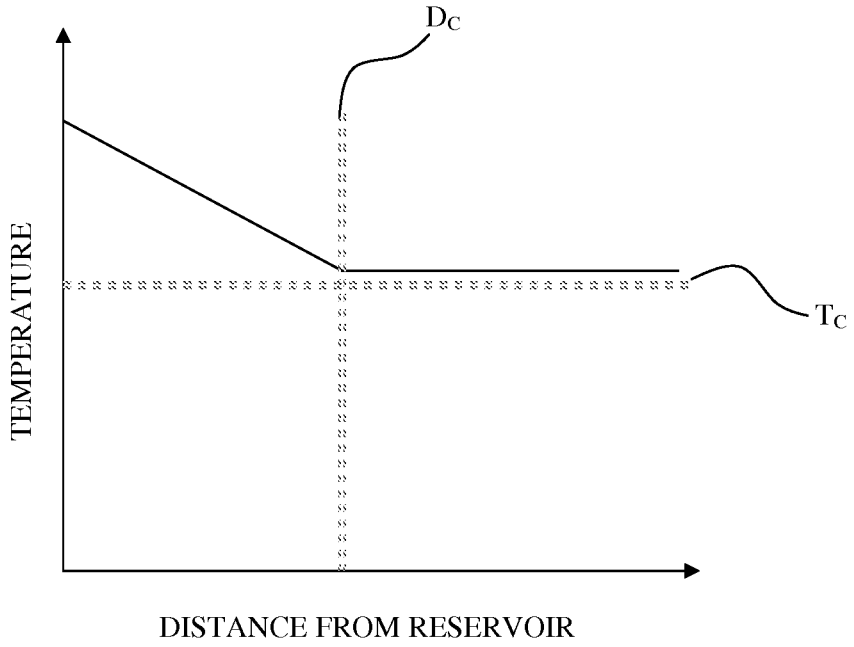
FIG. 7 depicts temperature variations associated with the application of FIG. 5 when used in conjunction with the heating cable of FIG. 1.

The build up of the wax-like material in the oil production pipe can be avoided by preventing the oil's temperature from dropping below the temperature at which the wax-like material precipitates out of the oil. This can be achieved by heating the oil production pipe using the heating cable of FIG. 1. It can be seen from FIG. 6 that at a specific distance from the reservoir the oil drops below the critical temperature TC at which the wax-like material precipitates out of the oil. Thus, if the heating cable of FIG. 1 is arranged to extend along the oil production pipe from the oil well and down to (and even in excess of) the depth at which the critical temperature TC of the oil is reached, the heating cable can be used to maintain the oil above this critical temperature as is extracted from the reservoir. FIG. 7 shows how the temperature of the oil is kept above the critical temperature TC at which the wax-like material precipitates out of the oil by introducing heat via the heating cable at a critical depth Dc from the oil well.

Figure 8:
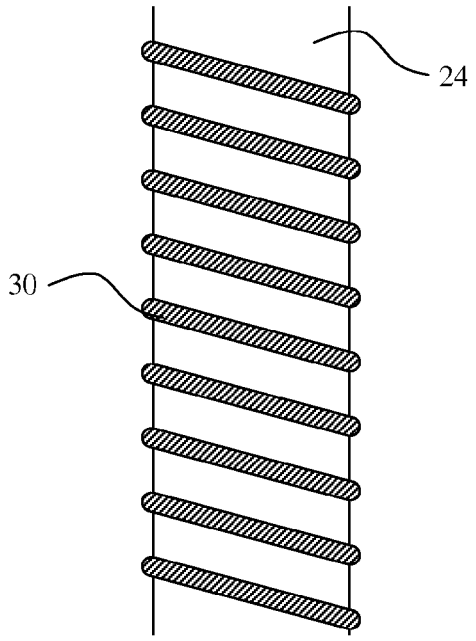
FIGS. 8 and 9 depict use of the heating cable of FIG. 1 in the application shown in FIG. 5.
Figure 9:
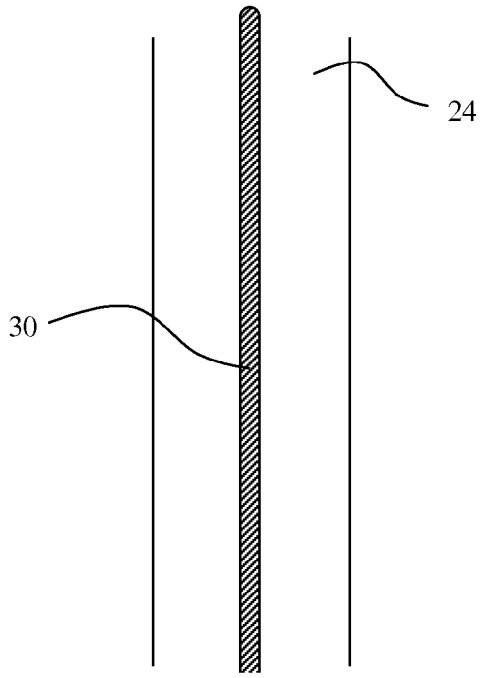

The heating cable may be arranged to heat the oil production pipe in any suitable manner and using any suitable configuration. For example, FIG. 8 shows how a heating cable according to embodiments of the present invention may be wound around the oil production pipe 24. The heating cable 30 may be wound around the inside of the oil well 24, or even built into the walls of the oil production pipe 24. FIG. 9 shows how the heating cable 30 may instead run longitudinally along the length of the oil production pipe 24.

The oil production pipe may be formed from a number of concentric pipes, and the heating cable may be arranged to extend in a gap provided between these concentric pipes.

The use of a three-phase heating cable is preferable, since the voltage drop along a three-phase heating cable is lower than the voltage drop along a single-phase heating cable of the same or similar length. A three-phase heating cable can have circuit lengths of many kilometers, whereas single-phase heating cables are limited to circuit lengths of a few hundred meters.

Figure 10:
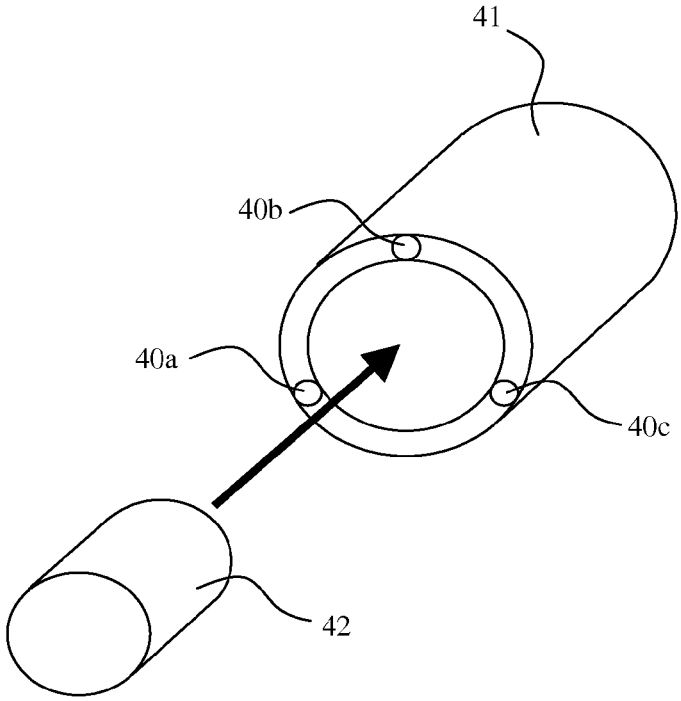
FIG. 10 depicts a heating cable according to another embodiment of the present invention and its use with the application of FIG. 5.

FIG. 10 depicts a heating cable according to another embodiment of the present invention. In this embodiment, instead of the conductors lying in the same plane, three conductors 40*a*, 40*b*, 40*c* are equally spaced around and extend along the wall of a hollow cylinder of PTC material 41. The conductors 40*a*, 40*b*, 40*c* are also equally spaced from a central longitudinal axis of the hollow cylinder of PTC material 41. This means that there are effectively three balanced conductive pathways: between conductors 40*a* and 40*b*, between conductors 40*b* and 40*c*, and between conductors 40*c* and 40*a*. One or more reasons for the obtaining of such a balance are described in more detail below.

The heating cable may have a shape that is substantially cylindrical, in that a slit could be provided in the cylinder 41 to allow the cable to be easily opened up and wrapped around an object.

The heating cable of FIG. 10 may have some or all the features described in relation to the heating cables of other embodiments described herein (e.g. an insulating sheath, conductors encased in a sheath of material having a negative temperature coefficient of resistance, etc.). FIG. 10 also shows how an object or material to be heated 42 may be located within the hollow cylinder of PTC material 41. Alternatively, the hollow cylinder of PTC material 41 may be located within the object or material to be heated 42, thereby allowing other objects or materials to be passed along and through the cylinder of PTC material 41.

In other embodiments, three conductors are equally spaced apart and extend along a PTC body that is not hollow (e.g. a solid mass of material). Looking at the cables end on, they may be distributed at the corners of a triangle, for example an equilateral triangle.

Figure 11:
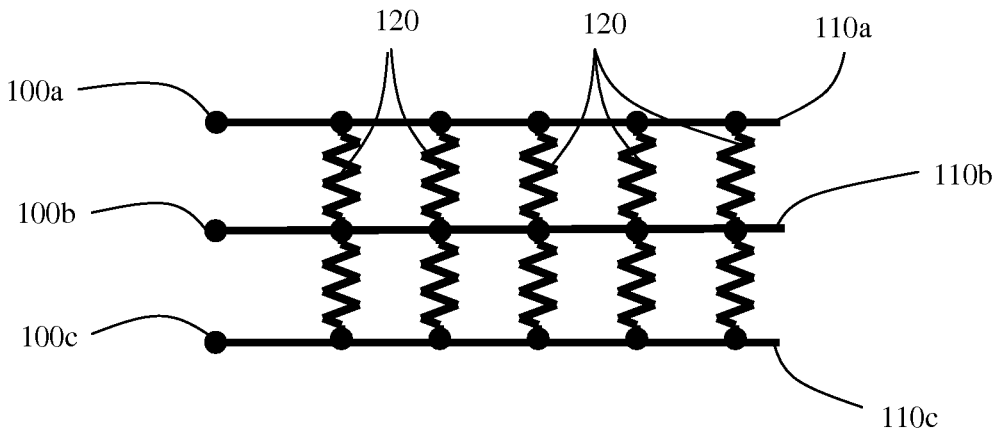
FIG. 11 depicts a schematic cross sectional view of a part of the heating cable according to another embodiment of the present invention.

In relation to FIG. 1, each of the conductors 1*a*, 1*b*, 1*c* were described as being, in use, attached to an output of a three-phase power supply (not shown). The heating cable was described as being able to be cut to length, with the ends of the conductors 1*a*, 1*b*, 1*c* not connected to the three-phase power supply being exposed and connected together in a star point. The star point is the path of least resistance between the conductors 1*a*, 1*b*, 1*c*. In another embodiment, the ends of the conductors 1*a*, 1*b*, 1*c* of the heating cable not connected to the three-phase power supply may remain unconnected. FIG. 11 schematically depicts the electrical connections of such a three-phase heating cable, which may still be cut to length.

Referring to FIG. 11, on the left hand side of the Figure is shown connection points 100*a*, 100*b*, 100*c* where electrical connection is made between the heating cable and a three-phase power supply (not shown). A PTC body in which conductors 110*a*, 110*b*, 110*c* are embedded is represented by a series of resistors 120. In practice, since the electrical conductors 110*a*, 110*b*, 110*c* are embedded in the PTC body, the number of resistors 120 will be effectively infinite (i.e. because the PTC body is continuous). It can therefore be seen that all the conductors 110*a*, 110*b*, 110*c* are in electrical connection with one another via the PTC body. On the right hand side of FIG. 11, the ends of the conductors 110*a*, 110*b*, 110*c* remote from the connection points to the power supply 100*a*, 100*b*, 100*c* are shown as not being physically connected to one another. In other words, these ends of the conductors 110*a*, 110*b*, 110*c* (and, for that matter, all parts of the conductors 110*a*, 110*b*, 110*c*) are in electrical connection with each other only via the electrically conductive heating element, i.e. the PTC body. By not physically connecting the remote ends of the conductors 110*a*, 110*b*, 110*c*, there is no fixed star point.

It has been found that having no fixed star point can be advantageous. Because the star point is not fixed, the star point can move. Movement of the star point means that the path of least resistance between the conductors 1*a*, 1*b*, 1*c* can also move. This means that heat generated by the cable may be delivered where it is needed, and not necessarily at equal or increasing or decreasing amounts along the entire length of the cable. For instance, when used to heat at least a part of an oil production pipe (for example, the oil production pipe described in relation to FIGS. 5 and 6), the star point may move (or be controlled to move) to a specific depth down the pipe (or in other words, distance along the cable). The specific depth may be such that heat is delivered at and above that point, but not below that point where, for example, oil already has a desired temperature.

Movement of the star point may depend on properties of the cable, such as conductor 1*a*, 1*b*, 1*c* material and dimensions, as well as dimensions and composition of the material in which the conductors 1*a*, 1*b*, 1*c* are embedded (e.g. a PTC body). Movement of the star point may also depend on properties of a three-phase signal passed through the cable (e.g. the voltage or current of the signal), and/or on the temperature of the cable. The star point may rapidly move from one position to another depending on changes in, for example, the driving signal, or may move more gradually as the driving signal changes. Movement of the star point may additionally or alternatively be a function of the temperature of the cable. This means that the star point may move as the temperature of the cable changes. This property can be taken advantage of, such that the star point moves to a location where heating is desired, for example at a depth in an oil production pipe above which oil is at an undesirably low temperature.

The heating cable shown in and described with reference to FIG. 11 can have one or more features of any other heating cable described herein.

The heating cables described herein have been described as being suitable for heating an oil production pipe. It will be appreciated that the heating cable may have other applications, for example heating pipes or other fluid carrying conduits. The heating cable may be used for any application where heating is required, and in particular where the use of a three phase power supply is advantageous, for example in situations where the heating cable must extend over large distances (due to the voltage drop per unit length being lower for a three phase cable than for a single phase cable).

Figure 12:
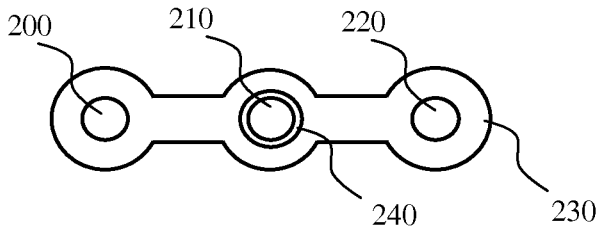
FIG. 12 depicts a schematic circuit diagram of electrical connections of a heating cable of another embodiment of the present invention.

In above embodiments three conductors have been described as being arranged in a planar configuration. An electrical load has been described as being surprisingly balanced between these conductors—i.e. the resistance, and thus load, between the inner conductor and each outer conductor is substantially the same as the resistance, and thus load, between the outer conductors. Such a balance may be achieved due the location or density of conductive pathways, as discussed above. It has been found, however, that the resistance between the conductors can be controlled to achieve a better or desired balance. FIG. 12 schematically depicts how such control may be achieved.

FIG. 12 shows an end on view of three power supply conductors 200, 210, 220 forming a self-regulating electrical heating cable. All three power supply conductors 200, 210, 220 are embedded in a body of PTC material 230. Outer conductors 200, 220 are equally spaced from inner conductor 210. This means that the resistance between each of outer conductors 200, 220 and inner conductor 210 will be the same. It might be expected that the resistance between the two outer conductors 200, 220 will be double the resistance between an outer conductor 200 and the inner conductor 210, since the outer conductors 200, 220 are separated by double the distance that separates the inner conductor 210 and an outer conductor 200, 220. This would result in an imbalanced resistance and thus load. However, this is not the case in the present embodiment.

In the present embodiment, the inner conductor 210 is provided with a coating (e.g. by extrusion or the like) of material 240. The coating of material 240 has an electrical resistance which is higher than that of the body of PTC material 230. The body of PTC material 230 extends around the coating of material 240. The resistance between each of outer conductors 200, 220 and inner conductor 210 will be dependent on the resistance of the coating of material 240 and on the resistance of the body of PTC material 230, but will still be the same. In contrast, the resistance between the two outer conductors 200, 220 will be less dependent on the coating of material 240, and more dependent on the resistance of the body of PTC material 230. Thus, if the resistance of the coating of material 240 is sufficiently high (and of a sufficient value), the resistance between each of outer conductors 200, 220 and the inner conductor 210 can be made to be the same, and equal to the resistance between the two outer conductors 200, 220. The provision of the coating of material 240 provides for a degree of control of the resistances and thus loads between the conductors 200, 210, 220. A balanced resistance configuration may be created, which will carry a balanced load.

The required resistance (i.e. resistivity and/or thickness, which will together affect the resistance) of the coating of material 240 can be calculated, or determined from modeling or experimentation to achieve the required balance in resistance and load. Preferably the coating of material 240 is also a PTC material, thus having the benefits of PTC materials as described above.

Instead of providing the coating of material 240, a same or similar effect may be achieved, deliberately or inadvertently, by the inner conductor 210 not being in good electrical contact with the body of PTC material 230, increasing the resistance between each of outer conductors 200, 220 and inner conductor 210. For instance, in the embodiments of FIGS. 1, 2 and/or 11, the balanced load may have been achieved by the outer conductors being in better electrical connection with the PTC body than the inner conductor (e.g. due to poor extrusion of the PTC body, or by not heating the inner conductor to cause the conductor to bond to or with the PTC body).

The heating cable shown in and described with reference to FIG. 12 can have one or more features of any other heating cable described herein.

In the above embodiments, the three electrical conductors are described as being embedded in a body of material. However, alternative arrangements are possible. For examples, a body could extend along the heating cable between, and in electrical connection with two of the conductors. Another body could extend between one of these conductors and the other conductor. That is, the bodies or body need not necessarily surround the conductors. It is however preferable that the conductors are embedded in a body to ensure that uniform electrical connections are made between each of the conductors.

The above embodiments have been described by way of example only and are not intended to limit the invention. It can be appreciated that various modifications may be made to these and indeed other embodiments while departing from the invention as defined by the claims that follow.

What is claimed is:

1. A self-regulating electrical heating cable comprising:

a first conductor extending along a length of the cable;

a second conductor extending along the length of the cable;

a third conductor extending along the length of the cable;

the first conductor, the second conductor, and the third conductor extending alongside one another in a substantially planar arrangement, the second conductor being located between the first conductor and the third conductor;

the first conductor and the second conductor being embedded in an electrically conductive heating element body having a positive temperature coefficient of resistance, the first conductor, the second conductor, and the third conductor being in electrical connection with each other, and physically separated from each other, via the electrically conductive heating element body;

the second conductor being provided with a coating of electrically conductive material separating the second conductor from the heating element body, the coating of electrically conductive material having a higher electrical resistance than the electrical resistance of the electrically conductive heating element body, wherein the cable exhibits a first resistance between the first conductor and the third conductor, and a second resistance substantially equal to the first resistance between the second conductor and each of the first conductor and the third conductor;

and wherein, at least in use, the first, second and third conductors are not physically connected to one another.

2. The self-regulating electrical heating cable of claim 1, wherein the first conductor and the third conductor are equally spaced from the second conductor.

3. The self-regulating electrical heating cable of claim 1, wherein one or more of the conductors are encased in material having a negative temperature coefficient of resistance.

4. The self-regulating electrical heating cable of claim 1, wherein the electrically conductive heating element body comprises two components, each component having a different positive temperature coefficient of resistance characteristic.

5. The self-regulating electrical heating cable claim 1, wherein the electrically conductive heating element body comprises a material having a negative temperature coefficient of resistance.

6. The self-regulating electrical heating cable of claim 3, wherein the material having a negative temperature coefficient of resistance is in the form of a sheath.

7. An electrical heating cable comprising:

an electrically conductive cable body of a material having a first resistivity with a positive temperature coefficient of resistance;

a first conductor, a second conductor, and a third conductor extending alongside one another, in thermal and electrical communication with the cable body, in a substantially planar arrangement, the second conductor being located between the first and third conductors; and an electrically conductive material physically separating the second conductor from the cable body and from the first conductor and from the third conductor and providing the thermal and electrical communication between the second conductor and the cable body, the electrically conductive material having a second resistivity higher than the first resistivity.

8. The cable of claim 7, wherein the electrically conductive material physically separating the second conductor from the cable body has a positive temperature coefficient of resistance.

9. The cable of claim 7, wherein the cable exhibits a first resistance between the first conductor and the third conductor, and a second resistance equal to the first resistance between the first conductor and the second conductor.

10. The cable of claim 7, wherein the first conductor and the third conductor are embedded in and in contact with the cable body.

11. The cable of claim 7, wherein the second conductor is physically separated from the first conductor and from the third conductor by the electrically conductive material and by the cable body.

12. The cable of claim 9, wherein the body exhibits a third resistance equal to the first resistance and the second resistance between the second conductor and the third conductor.

13. An electrical heating cable comprising:

an electrically conductive cable body of a first material;

a first conductor, a second conductor, and a third conductor extending alongside one another, in thermal and electrical communication with the cable body, in a substantially planar arrangement, the second conductor being located between and separated from the first and third conductors, the first conductor, the second conductor, and the third conductor being in electrical connection with each other via the cable body; and a resistive coating of a second material encompassing the second conductor and separating the second conductor from the cable body;

wherein the cable exhibits a first resistance between the first conductor and the third conductor, and a second resistance substantially equal to the first resistance between the first conductor and the second conductor.

14. The heating cable of claim 13, wherein the cable exhibits a third resistance equal to the first resistance and the second resistance between the second conductor and the third conductor.

15. The heating cable of claim 13, wherein the first material has a positive temperature coefficient of resistance.

16. The heating cable of claim 13, wherein the second material has a positive temperature coefficient.

17. The heating cable of claim 15, wherein the first material has a first resistivity and the second material has a second resistivity higher than the first resistivity.

* * * * *